US010101108B2

(12) United States Patent
Klein et al.

(10) Patent No.: US 10,101,108 B2
(45) Date of Patent: Oct. 16, 2018

(54) TAKEDOWN ASSEMBLY FOR ASSAULT RIFLE

(71) Applicants: Travis Klein, Redding, CA (US); Bart McCurdy, Redding, CA (US)

(72) Inventors: Travis Klein, Redding, CA (US); Bart McCurdy, Redding, CA (US)

( * ) Notice: Subject to any disclaimer, the term of this patent is extended or adjusted under 35 U.S.C. 154(b) by 0 days.

(21) Appl. No.: 15/870,916

(22) Filed: Jan. 13, 2018

(65) Prior Publication Data

US 2018/0156554 A1 Jun. 7, 2018

Related U.S. Application Data

(63) Continuation of application No. 15/490,943, filed on Apr. 19, 2017, now Pat. No. 9,909,828.

(60) Provisional application No. 62/384,168, filed on Sep. 6, 2016.

(51) Int. Cl.
*F41A 11/00* (2006.01)
*F41A 3/84* (2006.01)
*F41A 3/66* (2006.01)

(52) U.S. Cl.
CPC ..... *F41A 11/00* (2013.01); *F41A 3/66* (2013.01); *F41A 3/84* (2013.01)

(58) Field of Classification Search
CPC ..... F41A 11/00; F41A 11/02; F41A 11/04; F41A 35/00; F41A 3/66; F41A 3/84; F41A 3/08; F41A 3/78
USPC ..... 42/106, 108, 6
See application file for complete search history.

(56) References Cited

U.S. PATENT DOCUMENTS

| | | | | |
|---|---|---|---|---|
| 1,578,639 | A * | 3/1926 | Browning | F41A 3/58 42/42.01 |
| 2,465,196 | A * | 3/1949 | Browning | F41A 3/86 42/75.01 |
| 9,400,006 | B1 * | 7/2016 | Huang | F16B 19/02 |
| 9,777,977 | B1 * | 10/2017 | Makaron | F41A 11/00 |
| 2010/0281742 | A1 * | 11/2010 | Barrett | F41A 11/04 42/75.02 |
| 2012/0180354 | A1 * | 7/2012 | Sullivan | F41A 3/26 42/16 |
| 2013/0047482 | A1 * | 2/2013 | Mulfinger | F41C 27/00 42/84 |
| 2015/0260471 | A1 * | 9/2015 | Azhocar | F41A 11/00 42/90 |
| 2015/0308768 | A1 * | 10/2015 | Mills | F41A 11/04 42/75.03 |
| 2016/0109198 | A1 * | 4/2016 | Gardner | F41A 3/66 411/500 |

(Continued)

*Primary Examiner* — John Cooper
(74) *Attorney, Agent, or Firm* — Kevin Keener; Kevin and Associates, P.C.

(57) ABSTRACT

The present invention is directed toward a firearm takedown assembly. The preferred embodiment of the firearm takedown assembly comprises a docking plate configured to be removably secured to a firearm and a lever pivotably attached to the docking plate. The assembly may further comprise a pivot pin, wherein the lever is connected to the pivot pin. The lever is utilized to remove a takedown pin from the upper and lower receiver of the firearm so that a user may quickly disassembly the firearm. When the user desires to reassembly the user may thumb the lever to reinsert the takedown pin into the upper and lower receiver.

13 Claims, 13 Drawing Sheets

(56) References Cited

U.S. PATENT DOCUMENTS

| | | | | |
|---|---|---|---|---|
| 2017/0167812 | A1* | 6/2017 | Shaver | F41A 11/02 |
| 2017/0191780 | A1* | 7/2017 | Barrett | F41A 21/30 |

* cited by examiner

TAKEDOWN ASSEMBLY FOR ASSAULT RIFLE

PRIORITY

This application is a continuation of U.S. application Ser. No. 15/490,943, filed Apr. 19, 2017, the disclosure of which is hereby incorporated by reference. U.S. application Ser. No. 15/490,943 claims priority to U.S. Provisional Patent Application Ser. No. 62/384,168, filed Sep. 6, 2016, the disclosure of which is hereby incorporated by reference.

FIELD OF THE INVENTION

The invention is directed to a firearm accessory and more specifically to a rear mounted takedown assembly for an assault rifle which permits the quick and easy separation and unification of a top receiver and lower receiver of an assault rifle.

BACKGROUND OF INVENTION

Semi-automatic firearms have been known for a long time. The first semi-automatic rifle was introduced in 1885. The M-16 automatic rifle has been used by the military for years. A civilian version of the M-16 is known as the AR-15 and is a semi-automatic rifle. The AR-15 has been manufactured and sold to civilians for many years. Standard AR-15 semi-automatic rifles are manufactured and distributed with an upper receiver and a lower receiver. The upper receiver and lower receiver are normally attached together at two locations by locking pins which pass through holes in the upper receiver and lower receiver. A locking pin in the front is known as the front takedown pin. A locking pin in the rear is known as the rear takedown pin. A user who wants to remove the upper receiver from the lower receiver to clean the internal action of the firearm must first remove the rear takedown pin and front takedown pin to allow access to the action of the firearm. Alternatively, if the user removes only the rear takedown pin, then the upper receiver can pivot away from the lower receiver with the front takedown pin acting as the pivot point.

Removing only the rear takedown pin allows a user to quickly separate the upper receiver from the lower receiver. However, this process has its flaws. A user can accidentally misplace the rear takedown pin. This would prevent the user from quickly reinserting the rear takedown pin and utilizing the firearm. What is needed is a firearm accessory which allows a user to remove the rear takedown pin to separate the upper receiver from the lower receiver without needed to completely removing the rear takedown pin from the complete firearm assembly.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The invention is directed toward a firearm takedown assembly. The firearm takedown assembly comprises a docking plate configured to be removably secured to a firearm and a lever pivotably attached to the docking plate.

The assembly may further comprise a pivot pin, wherein the lever is connected to the pivot pin.

In another embodiment the assembly may further comprise a takedown pin. The takedown pin further may also comprise a groove extending along at least a portion of the takedown pin.

In another embodiment the docking plate further comprises a central aperture for mounting the docking plate to a rear buffer tube of a firearm.

The docking plate may further comprise one or more protrusions, wherein each of the one or more protrusions has a pivot pin hole for receiving the pivot pin. In addition the lever may further comprise a pivot plate extending from a side of the lever, the pivot plate having a pivot hole for receiving the pivot pin. The lever may also further comprise an end aperture disposed at an end of the lever.

In another embodiment the assembly further comprises a spring configured to return the lever to a predetermined position. In addition the assembly may further comprise one or more screws for attaching the docking plate to the firearm.

The invention is also directed toward a firearm comprising a lower receiver, an upper receiver, a lever pivotably attached to a portion of the firearm, and a takedown pin attached to an end of the lever. The take down pin is configured to secure the lower receiver to the upper receiver. The lever is configured to alternate the takedown pin from a closed position wherein the takedown pin is engaged with the lower receiver and upper receiver and an open position wherein the takedown pin is disengaged from the lower receiver and upper receiver.

The firearm may further comprise a docking plate removably secured to a portion of the firearm and wherein the lever is pivotably attached to the docking plate. In addition the firearm may further comprise a pivot pin attached to the docking plate and the lever. In another embodiment of the firearm, the docking plate further comprises a central aperture for mounting the docking plate on a buffer tube of the firearm.

The invention is also directed toward a firearm accessory comprising a lever configured to be pivotably attached to an external surface of a firearm, the lever having a first end and a second end, wherein when the lever is utilized on the firearm the first end of the lever is connected to a takedown pin, wherein the takedown pin is configured to secure an upper receiver of a firearm to a lower receiver of a firearm.

The invention is also directed toward a method of opening an action of a firearm, the firearm comprising an upper receiver and a lower receiver, the method comprising pressing a first end of a lever pivotably attached to an external surface of the firearm in a direction toward the firearm, wherein the second end of the lever is connected to a takedown pin, wherein the takedown pin is configured to secure the upper receiver to the lower receiver, whereby pressing the first end of the lever toward the firearm moves the takedown pin to a disengaged position permitting the upper receiver to at least partially detach from the lower receiver.

The method may further comprise at least partially separating the upper receiver from the lower receiver. The method may further comprise fully joining the upper receiver to the lower receiver. The method may further comprise pressing the first end of the lever in a direction away from the firearm, whereby pressing the first end of the lever away from the firearm moves the takedown pin to an engaged position securing the upper receiver to the lower receiver.

Still other embodiments of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE PREFERRED EMBODIMENT

Figure 1A:
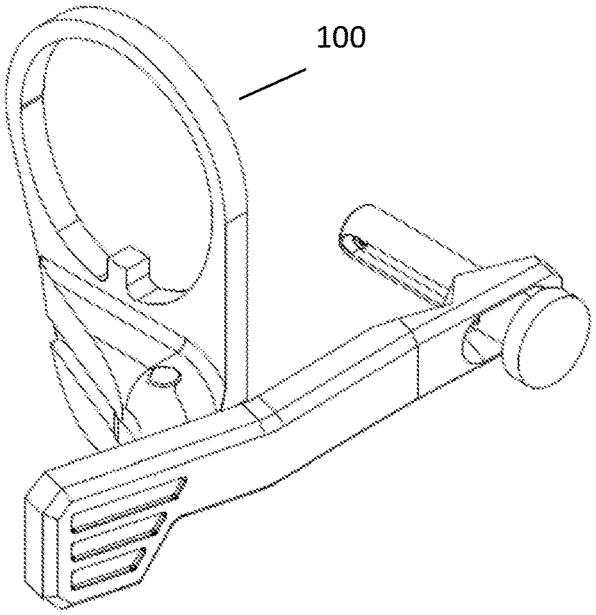
FIG. 1A is a top right perspective view of the rear takedown assembly.
Figure 1B:
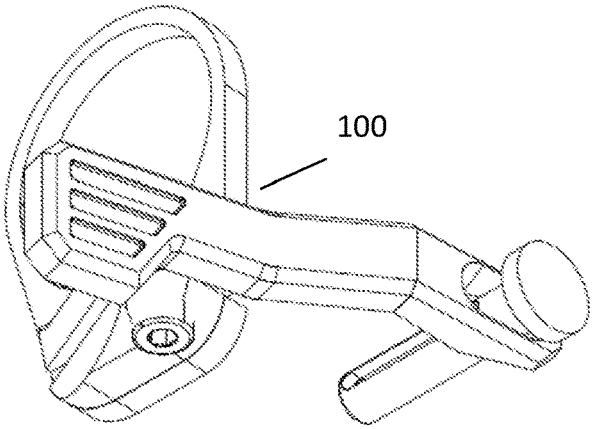
FIG. 1B is a bottom right perspective view thereof.
Figure 1C:
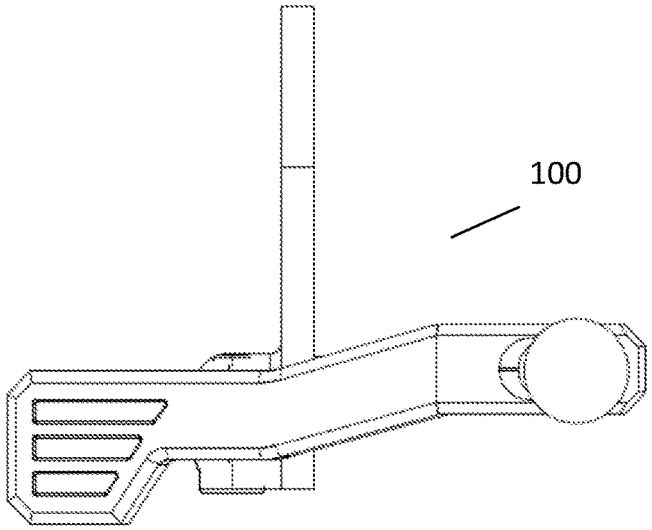
FIG. 1C is a is a right plan view thereof.
Figure 1D:
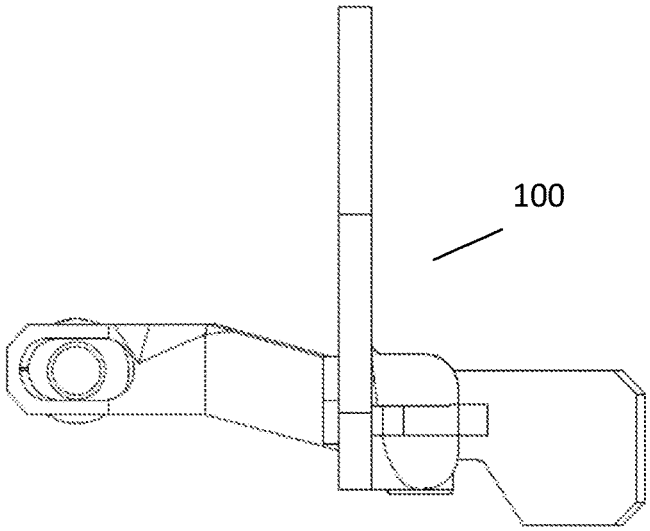
FIG. 1D is a left plan view thereof.
Figure 1E:
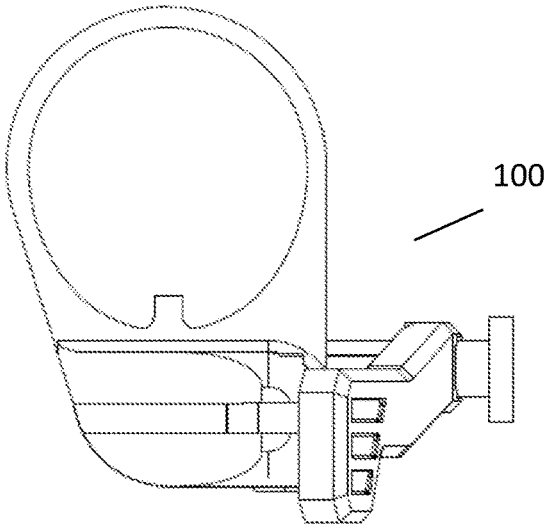
FIG. 1E is a front plan view thereof.
Figure 1F:
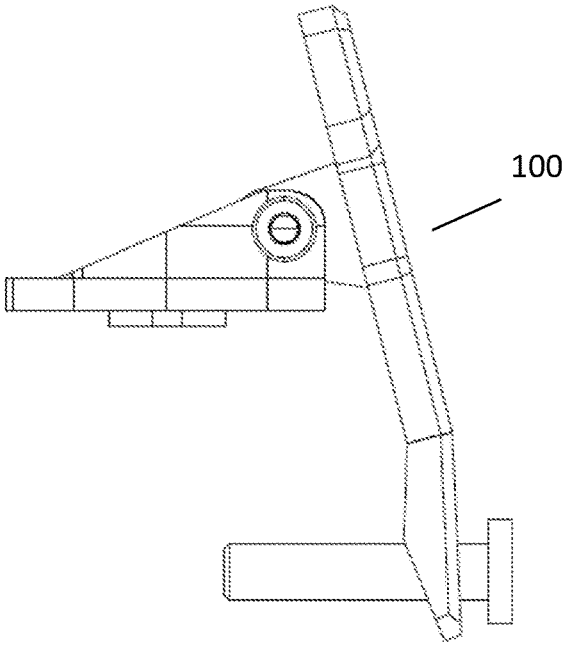
FIG. 1F is a bottom plan view thereof.
Figure 2:
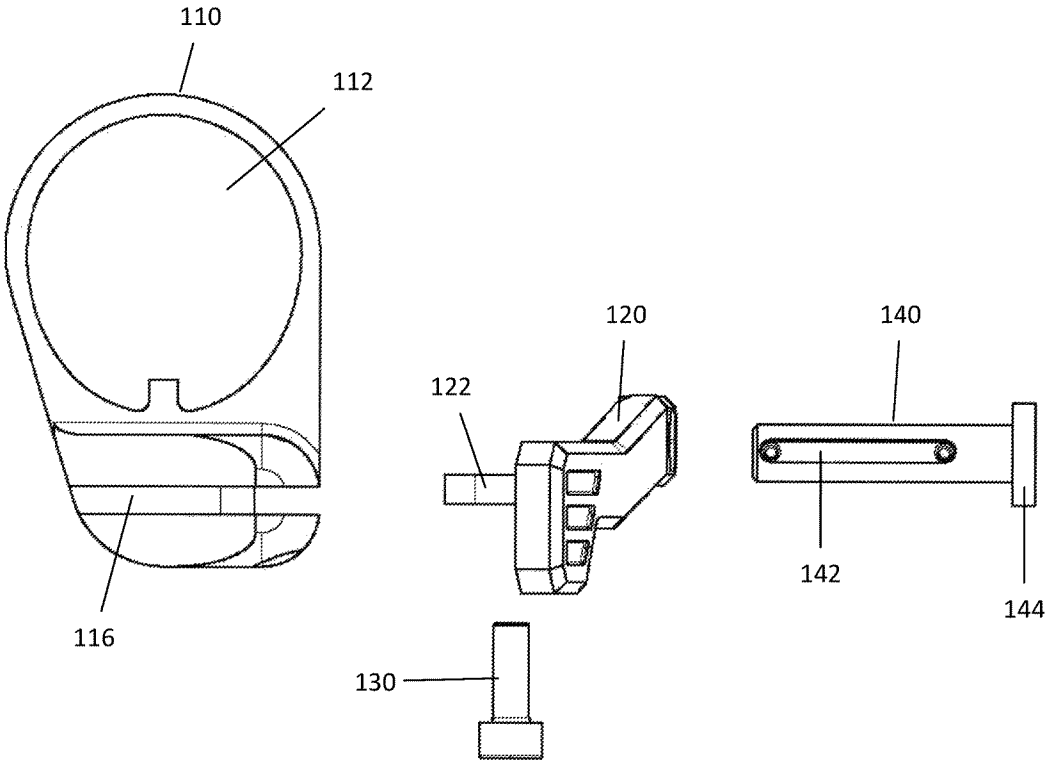
FIG. 2 is a front exploded view thereof.
Figure 3:
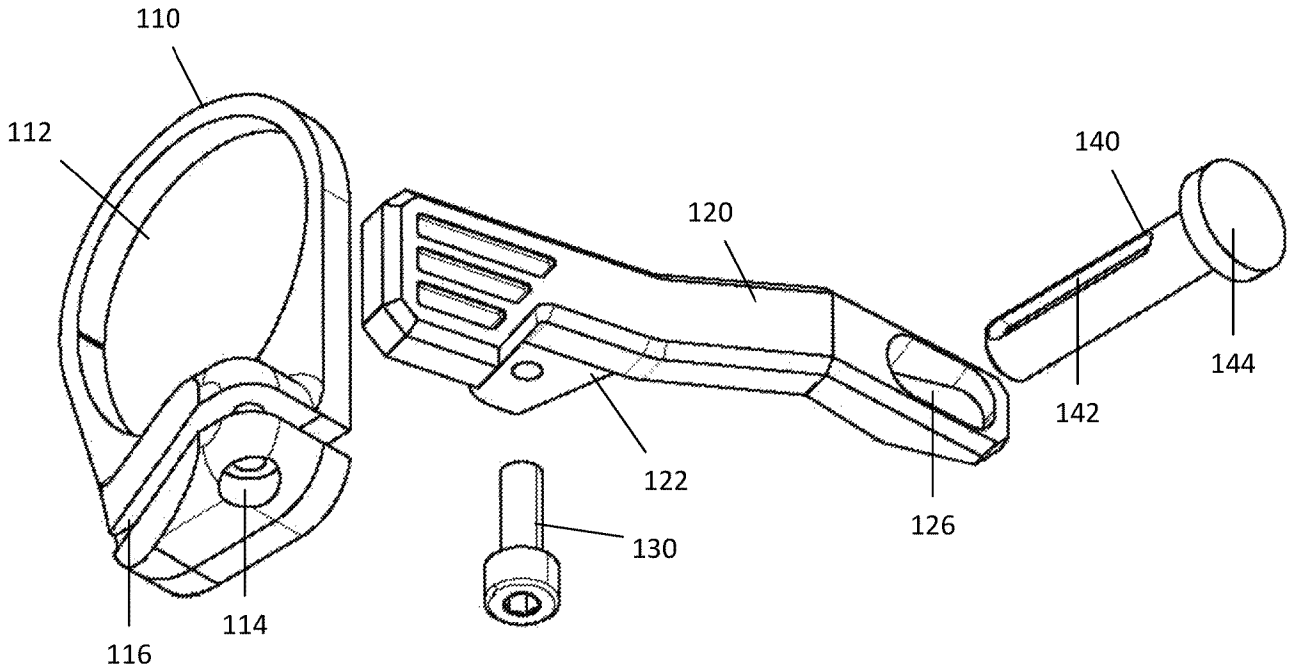
FIG. 3 is a bottom right perspective exploded view thereof.
Figure 4:
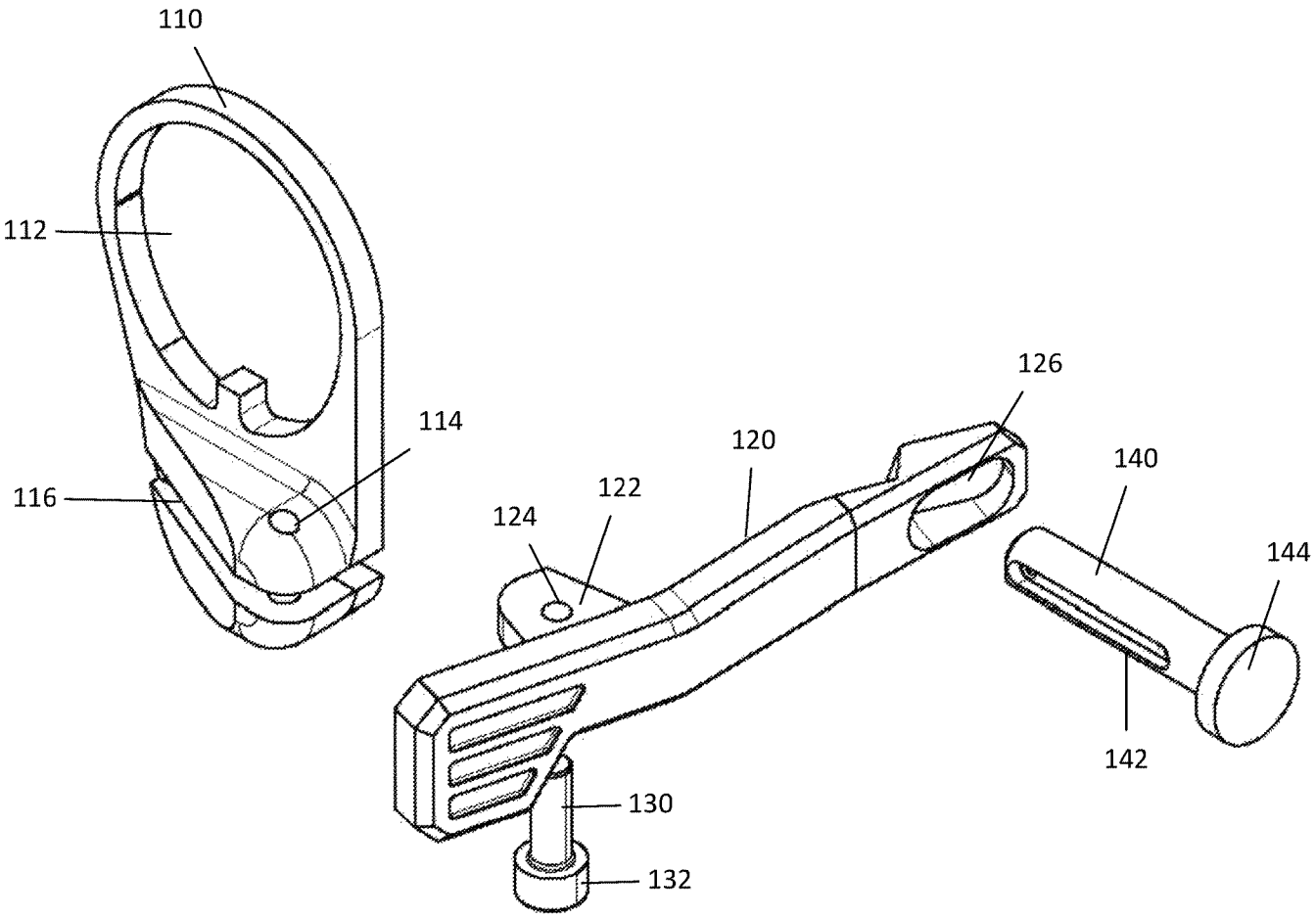
FIG. 4 is a top right perspective exploded view thereof.
Figure 5:
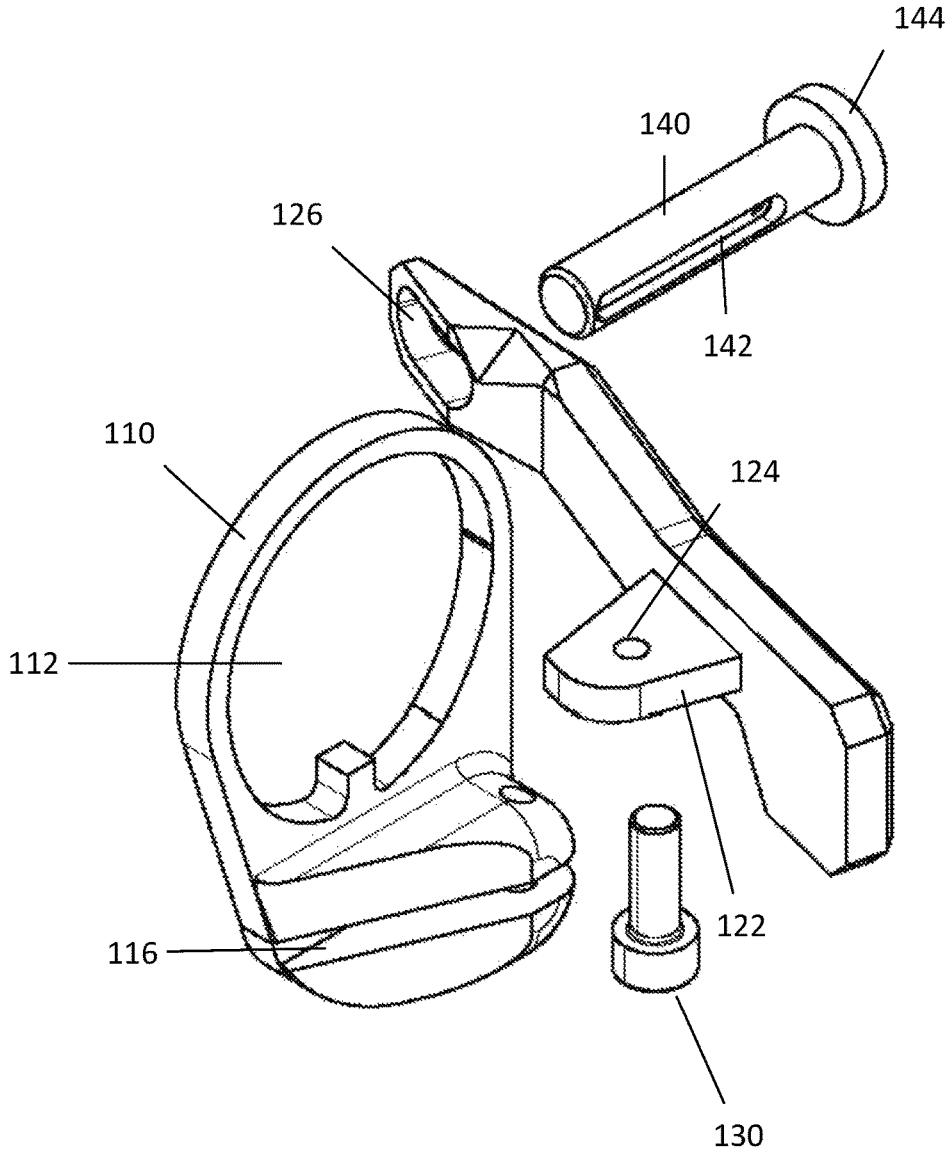
FIG. 5 is a top left perspective exploded view thereof.
Figure 6:
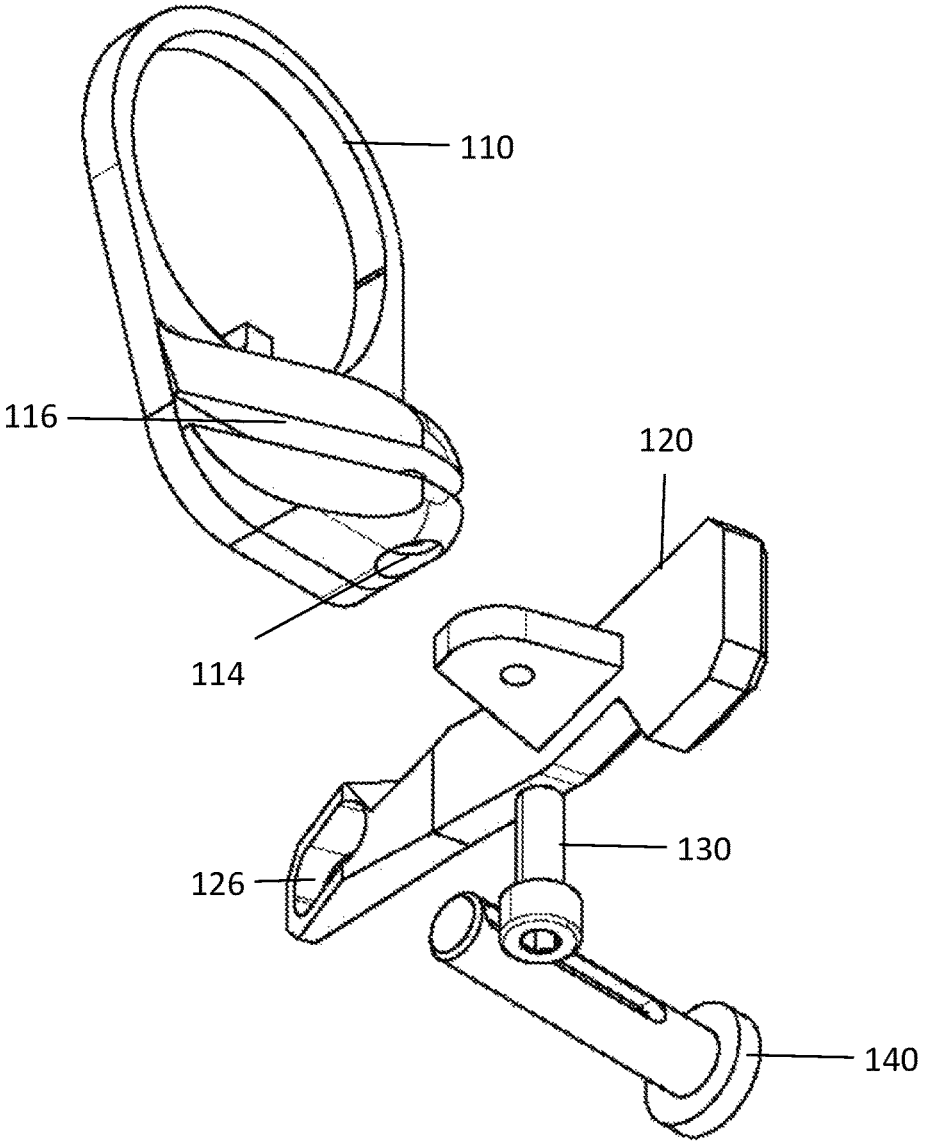
FIG. 6 is a bottom left perspective exploded view thereof.

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

Referring to FIG. 1A-FIG. 6, the preferred embodiment of the invention is displayed. The invention is directed toward a rear mounted takedown assembly 100. The takedown assembly 100 may come in any configuration which permits a rear takedown pin to be removed and reinserted into the upper and lower receiver of the firearm. In the preferred embodiment the takedown assembly 100 comprises a docking plate 110, a lever 120, a pivot pin 130, and a takedown pin 140.

Referring to FIGS. 3-6, the separate components of the takedown assembly 100 are illustrated in detail. The docking plate 110 is a mounting unit configured to mount the takedown assembly 100 onto the firearm. The docking plate 110 may be in any configuration permitting the takedown assembly 100 to be mounted onto the firearm. In the preferred embodiment, the docking plate 110 has a central aperture 112. The central aperture 112 is configured to receive a buffer tube from a firearm. The central aperture 112 is preferably circular in shape but may be any size and shape. The central aperture 112 may have one or more protrusions extending into central aperture 112 to keep the docking plate 110 fixed onto the buffer tube and prevent the docking plate 110 from rotating about the buffer tube. In other embodiments the docking plate 110 may not have a central aperture 112 and instead be attached directly to the upper receiver or directly to the lower receiver by a known means, such as with screws or adhesive. In this way the docking assembly 100 may stay attached to either the upper receiver or lower receiver when the upper receiver is separated from the lower receiver.

In the preferred embodiment, the docking plate 110 may also have a slot 116. The slot 116 traverses the docking plate 110 horizontally. The slot 116 is formed by two protrusions extending outward from the plane of the docking plate 110. In other embodiments there may be only one protrusion extending from the docking plate 100. The protrusions forming the slot 116 permit the lever 120 to be attached to the docking plate 110. Extending vertically through the protrusions is a pivot pin hole 114. The pivot pin hole 114 is configured to receive the pivot pin 130.

The lever 120 is an elongated arm. The lever 120 may be in any size and shape. In the preferred embodiment the lever 120 has a pivot plate 122. The pivot plate 122 is configured to fit within the slot 116 of the docking plate 110. If the docking plate 110 does not have a slot 116 then the pivot plate 122 abuts the protrusion of the docking plate 110. In the preferred embodiment the pivot plate 122 has a pivot pin hole 124 configured to receive the pivot pin 130. The lever 120 also has an end aperture 126. The end aperture 126 is configured to receive the takedown pin 140.

The pivot pin 130 may be any size and shape. In the preferred embodiment the pivot pin 130 is a long cylindrical member. The pivot pin 130 may also have a flange 132 disposed at one end of the pivot pin 130. The pivot pin 130 may have threading about the end of the pivot pin 130 distal from the flange 132. The pivot pin 130 is configured to pass through the pivot pin hole 124 of the lever 120 and the pivot pin hole 114 of the docking plate 110. The pivot pin 130 thus attaches the lever 120 to the docking plate 110. The lever 120 then pivots back and forth about the pivot pin 130.

The takedown pin 140 may be any size and shape. In the preferred embodiment the takedown pin 140 is an elongated cylindrical member. In one embodiment the takedown pin 140 is a standard OEM style of takedown pin. The takedown pin 140 has a flange 144. The body of the takedown pin 140 fits through the end aperture 126 of the lever 120 and extends into rear takedown pin holes of the upper and lower receiver. In the preferred embodiment illustrated the takedown pin 140 has a groove 142. The groove 142 is configured to receive a detent pin in the lower receiver.

Figure 7:
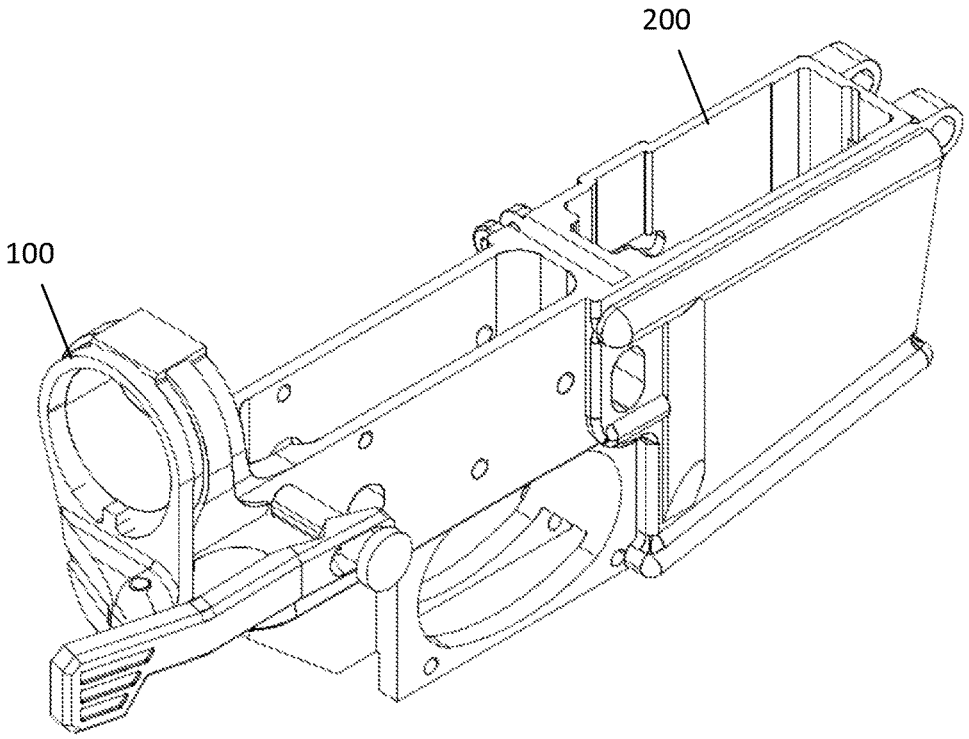
FIG. 7 is a top right perspective view of the rear takedown assembly mounted on a lower receiver.
Figure 8:
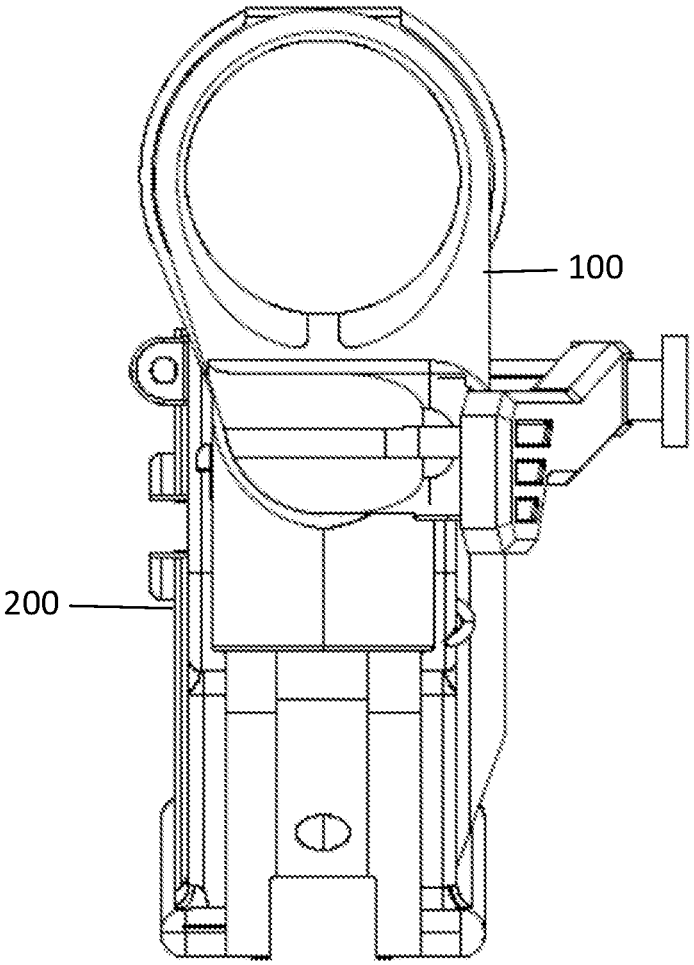
FIG. 8 is a front plan view thereof.
Figure 9:
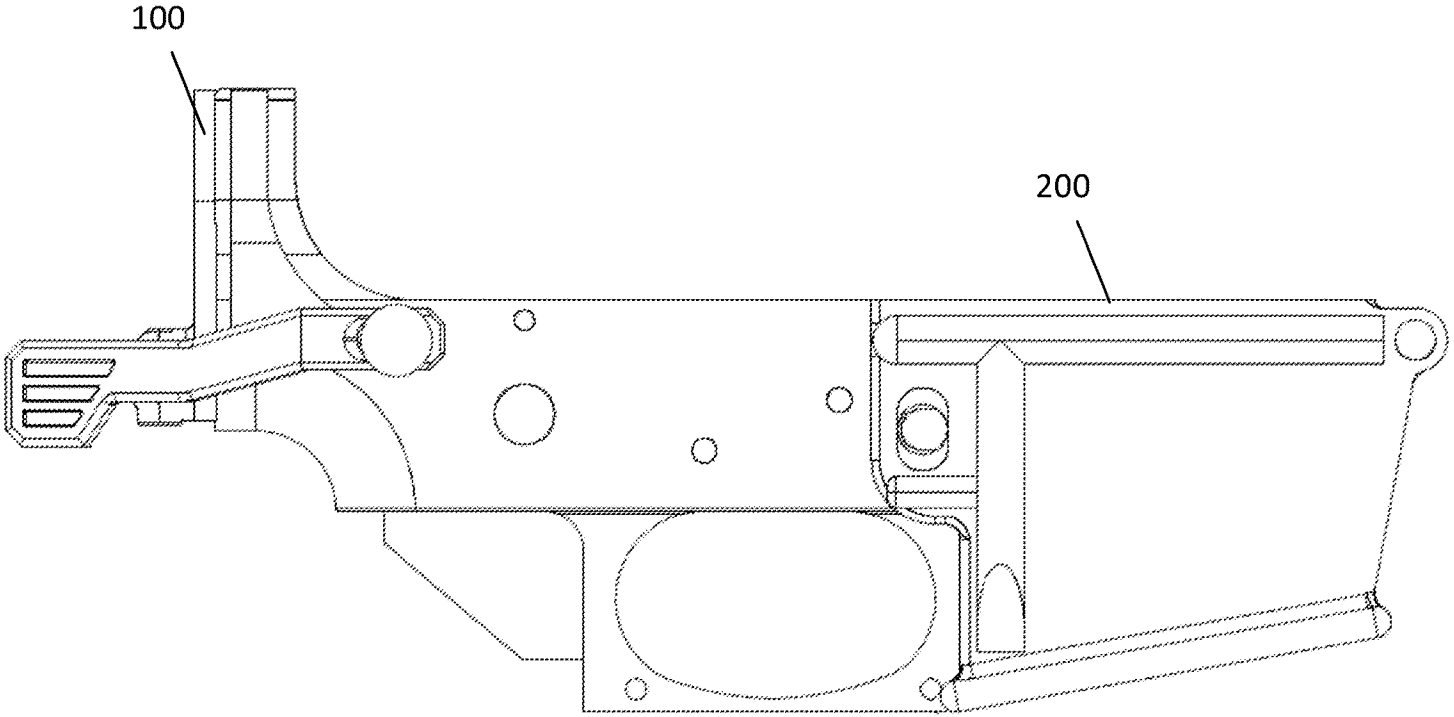
FIG. 9 is a right plan view thereof.

Referring to FIGS. 7-9, the takedown assembly 100 is mounted on the lower receiver 200. The takedown assembly 100 is mounted on a rear section of the lower receiver 200. In other embodiments the takedown assembly is mounted on the upper receiver of the firearm.

The invention is also directed toward a method for retrofitting an existing firearm with the takedown assembly 100. First the user removed the OEM takedown pin. Next the user mounts the takedown assembly 100 to the lower receiver or the upper receiver of the firearm. The user may mount the takedown assembly 100 by screwing the takedown assembly 100 to the firearm, using adhesive to attach the takedown assembly 100 to the firearm, or sliding the buffer tube through the central aperture 112 of the docking plate 110. The user then inserts the takedown pin 140 of the takedown assembly 100 into the receiver holes in the upper and lower receiver. If the user decides to use the OEM takedown pin then the user can insert the OEM takedown pin into the end aperture 126 of the lever 120. To utilize the invention after it is installed the user pushed on the end of the lever 120 distal from the takedown pin 140. The lever 120 pivots about the pivot pin 130, moving the proximal end of the lever 120 away from the firearm. The movement of the proximal end of the lever 120 pulls the takedown pin 140 out of the receiver holes in the upper and lower receiver. The user can then rotate the upper receiver away from the lower receiver. The user may rotate the upper receiver a large distance away from the lower receiver or only a small distance. When the user is ready to fire the firearm again, the user rotates the upper receiver back in place against the lower receiver. The user then pushes the distal end of the lever 120 outward and away from the firearm. The lever 120 pivots about the pivot pin 130, causing the proximal end of the lever 120 to move towards the firearm. As the proximal end of the lever 120 moves towards the firearm, the lever 120 pushes the takedown pin 140 back into place into the receiver holes in the upper and lower receiver. The firearm action is now closed and locked together and the user may fire the firearm.

The takedown assembly may have additional components which enhance the functionality of the takedown assembly. For instance, the takedown assembly may have a spring attached between the lever 120 and the docking plate 110 which automatically causes the lever 120 to return to the closed position where the takedown pin 140 is engaged with the upper receiver and lower receiver. The spring may also be disposed around the pivot pin 130 with one end of the spring pushing against a portion of the lever 120 and the other end of the spring pushing against the docking plate 110.

In another embodiment of the invention the takedown pin 140 is an extension protruding from the end of the lever 120 such that the lever 120 and takedown pin 140 are one coformed component.

In another embodiment of the invention the assembly may not have a docking plate 110. In this embodiment the lever 120 is directly attached to either the upper receiver or the lower receiver 200. This embodiment of the invention would be best utilized as part of an OEM component attached to a firearm sold from a manufacturer rather than an assembly for retrofitting a previously manufactured firearm. The lever 120 may be directly connected to any surface of the firearm or may be mounted on one or more components which are themselves attached to the surface of the firearm.

The takedown assembly 100 may be made from any type of material such as metal or polymer. In the preferred embodiment the takedown pin 140 is made from a polyoxymethylene, a thermoplastic which was developed for high stiffness and low friction. This material is known by a variety of tradenames such as Delrin, Celcon, Ramtal, Duracon, Kepital, and Hostaform. The polyoxymethylene is a low friction and self-lubricating material which enhances the functionality of the takedown pin 140. As a metal takedown pin 140 is moved in and out of the receiver holes of the upper receiver and lower receiver, the takedown pin becomes worn and friction between the takedown pin 140 and the receivers can cause the takedown pin 140 to become stuck or difficult to remove. Lubricants such as gun oil can help solve this problem but lubricants are short lived and can eventually wear away—providing only a short term solution to the problem. The use of polyoxymethylene solves this solution by allowing the takedown pin 140 to have an inherently lower amount of friction against the receivers. Also, as the takedown pin 140 is moved against the receivers, the polyoxymethylene releases a small amount of lubricant from the material, providing a long term solution to the problem of sticking. In addition the use of polyoxymethylene protects the upper receiver and lower receiver. This is because the hole holding the takedown pin can wear down and break from overuse if the takedown pin is made of metal and is removed and inserted repeatedly.

The invention may be utilized for any takedown pin. The preferred embodiment of the invention is utilized to remove and insert a rear takedown pin. However, the same invention may be utilized to remove and insert a front takedown pin as well. The invention may be used on either the rear takedown pin or the front takedown pin, or on both takedown pins simultaneously.

Figure 10A:
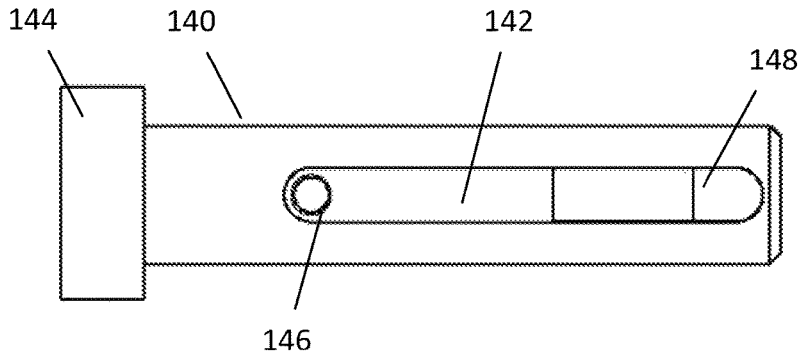
FIG. 10A is a top plan view of the preferred embodiment of the pin.
Figure 10B:
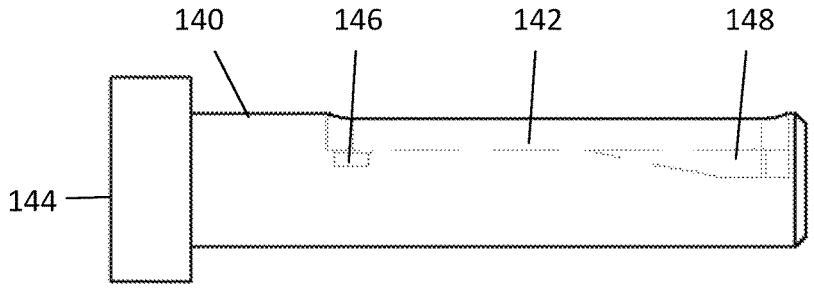
FIG. 10B is a side plan view thereof.
Figure 10C:
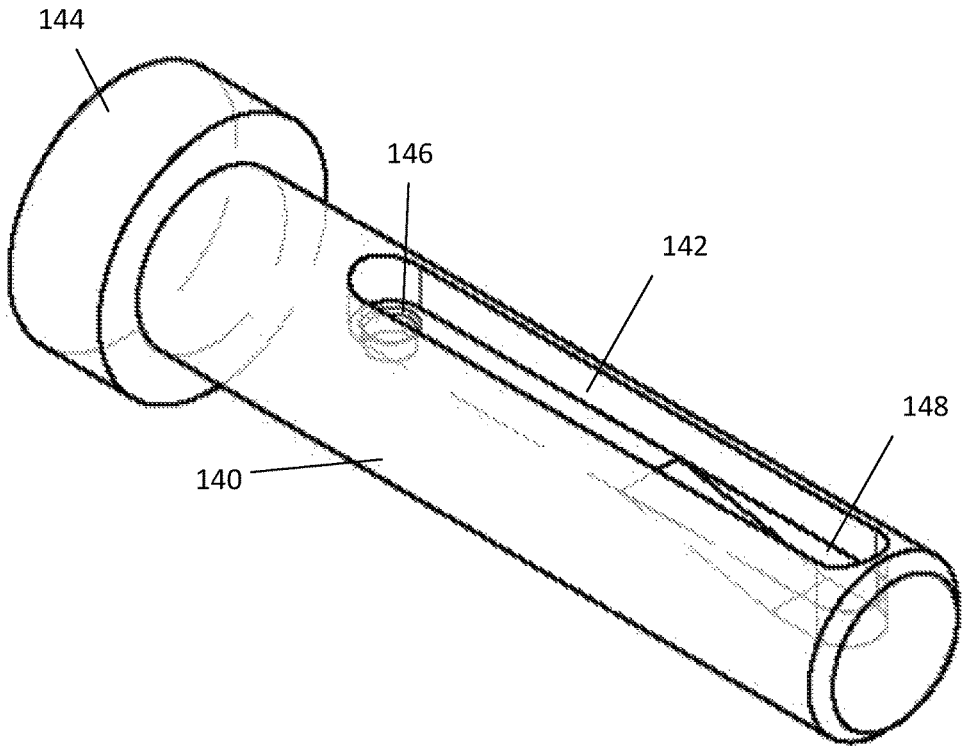
FIG. 10C is a top perspective view thereof.

Referring to FIGS. 10A-C, the preferred embodiment of the takedown pin 140 is illustrated. In the preferred embodiment of the takedown pin 140, the takedown pin 140 has a flange 144 and a groove 142. The flange 144 provides an external surface of the takedown pin 140 for a user to grab and remove the takedown pin 140 if the user desires. The flange 144 also provides a connection point for the lever 120 to remove the takedown pin 140 from the lower receiver 200. The groove 142 may be any depth and shape. A detent pin from the lower receiver (not shown) is disposed within the groove 142 which prevents the takedown pin 140 from being fully removed from the receivers. In the preferred embodiment the outer end of the groove 140 has an outer recess 146. The outer recess 146 is a depression further into the groove 142 which holds the detent pin and prevents the takedown pin 140 from unintentionally being removed from the receivers. The inner end of the groove 142 has an inner recess 148. As illustrated in the preferred embodiment, the inner recess 148 has a triangular shape which operates as a ramp for the detent pin. The ramp shape of the inner recess 148 ensures that the detent pin does not hold the takedown pin 140 in an unengaged position. The ramp shape ensures that the takedown pin 140 is easily reinserted into the upper receiver and lower receiver when the user desires to reattach the upper receiver and lower receiver. In the preferred embodiment, the detent pin cannot get stuck at the inner recess 148 but slides upward along the ramp through the groove 142 to the outer recess 146.

Other embodiments to the invention are possible without departing from the spirit of the invention. For instance, the invention may utilize a single lever 120 and single takedown pin 140 entering from one side of the firearm. In other embodiments of the invention there may be a lever 120 on each side of the firearm, with each lever having a takedown pin 140 inserted into the firearm. In other embodiments the lever 120 is connected to a connection unit which holds the takedown pin 140 rather than being connected directly to the takedown pin 140.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

The invention claimed is:

1. A firearm comprising a) a lower receiver;

b) an upper receiver;

c) a lever pivotably attached to a portion of said firearm;

d) a takedown pin attached to an end of said lever, wherein said take down pin is configured to secure said lower receiver to said upper receiver;

e) wherein said lever is configured to alternate said takedown pin from a closed position wherein said takedown pin is engaged with said lower receiver and upper receiver and an open position wherein said takedown pin is disengaged from said lower receiver and upper receiver.

2. The firearm as in claim 1 wherein said lever is pivotably attached to said lower receiver.

3. The firearm as in claim 1 wherein said lever is pivotably attached to said upper receiver.

4. The firearm as in claim 1 further comprising a docking plate removably secured to a portion of said firearm and wherein said lever is pivotably attached to said docking plate.

5. The firearm as in claim 4 further comprising a pivot pin attached to said docking plate and said lever.

6. The firearm as in claim 5 wherein said docking plate further comprises a central aperture for mounting said docking plate on a buffer tube of said firearm and wherein said docking plate is mounted on said firearm.

7. A firearm comprising a) a lower receiver;

b) an upper receiver; and c) an accessory comprising a lever pivotably attached to an external surface of said firearm, said lever having a first end and a second end, wherein when said lever is utilized on said firearm said first end of said lever is connected to a takedown pin, wherein said takedown pin is configured to secure a portion of said upper receiver to a portion of said lower receiver.

8. The firearm as in claim 7 wherein said accessory is attached to a portion of said upper receiver.

9. The firearm as in claim 7 wherein said accessory is attached to a portion of said lower receiver.

10. A method of opening an action of a firearm, said firearm comprising an upper receiver and a lower receiver, said method comprising a) pressing a first end of a lever pivotably attached to an external surface of said firearm in a direction toward said firearm, wherein said second end of said lever is connected to a takedown pin, wherein said takedown pin is configured to secure said upper receiver to said lower receiver, whereby pressing said first end of said lever toward said firearm moves said takedown pin to a disengaged position permitting said upper receiver to at least partially detach from said lower receiver.

11. The method as in claim 10 further comprising at least partially separating said upper receiver from said lower receiver.

12. The method as in claim 11 further comprising fully joining said upper receiver to said lower receiver.

13. The method as in claim 12 further comprising pressing said first end of said lever in a direction away from said firearm, whereby pressing said first end of said lever away from said firearm moves said takedown pin to an engaged position securing said upper receiver to said lower receiver.

* * * * *